US008835785B2

(12) United States Patent
Yamada et al.

(10) Patent No.: US 8,835,785 B2
(45) Date of Patent: Sep. 16, 2014

(54) KEY SWITCH STRUCTURE

(75) Inventors: Shigeru Yamada, Gunma (JP); Yasushi Takagi, Gunma (JP)

(73) Assignee: Oki Electric Industry Co., Ltd., Tokyo (JP)

( * ) Notice: Subject to any disclaimer, the term of this patent is extended or adjusted under 35 U.S.C. 154(b) by 257 days.

(21) Appl. No.: 13/063,750

(22) PCT Filed: Jun. 16, 2009

(86) PCT No.: PCT/JP2009/060960

§ 371 (c)(1),
(2), (4) Date: Mar. 11, 2011

(87) PCT Pub. No.: WO2010/038517

PCT Pub. Date: Apr. 8, 2010

(65) Prior Publication Data

US 2011/0168537 A1 Jul. 14, 2011

(30) Foreign Application Priority Data

Oct. 2, 2008 (JP) ..... 2008-257599

(51) Int. Cl.
*H01H 13/50* (2006.01)
*H01H 13/83* (2006.01)
*H01H 3/12* (2006.01)

(52) U.S. Cl.
CPC ..... *H01H 13/83* (2013.01); *H01H 2219/06* (2013.01); *H01H 2219/056* (2013.01); *H01H 2219/062* (2013.01); *H01H 3/125* (2013.01)
USPC ..... 200/344; 200/310; 200/314

(58) Field of Classification Search
USPC ..... 200/344
See application file for complete search history.

(56) References Cited

U.S. PATENT DOCUMENTS

| | | | | |
|---|---|---|---|---|
| 6,860,612 | B2 * | 3/2005 | Chiang et al. | 362/29 |
| 7,154,059 | B2 * | 12/2006 | Chou | 200/314 |
| 7,388,167 | B2 * | 6/2008 | Liao et al. | 200/310 |
| 2007/0235306 | A1 | 10/2007 | Chiba et al. | |
| 2008/0030975 | A1 | 2/2008 | Miyashita et al. | |

FOREIGN PATENT DOCUMENTS

| | | | |
|---|---|---|---|
| CN | 1532674 | A | 9/2004 |
| CN | 101051569 | A | 10/2007 |
| JP | 2001-229764 | A | 8/2001 |
| JP | 2002-216576 | | 8/2002 |
| JP | 2002-260478 | A | 9/2002 |

(Continued)

OTHER PUBLICATIONS

Chinese Office Action with Its English-language Translation, issued on Nov. 20, 2013, in connection with the corresponding Chinese patent application No. 200980130436.X.

*Primary Examiner* — Renee Leubke
*Assistant Examiner* — Ahmed Saeed
(74) *Attorney, Agent, or Firm* — Rabin & Berdo, P.C.

(57) ABSTRACT

A key switch structure capable of reducing the height of a key switch, reducing the number of components, and reducing manufacturing costs. The key switch structure includes: a key top; first and second linking mechanisms and adapted to support the key top; a membrane sheet having a contact point portion; a back plate disposed below the membrane sheet and having a function to guide light; and an LED sheet having an LED as a light emitting element disposed thereon, wherein the LED is disposed to be adjacent to the back plate.

7 Claims, 9 Drawing Sheets

(56) References Cited

FOREIGN PATENT DOCUMENTS

| | | | |
|---|---|---|---|
| JP | 2002-298689 | | 10/2002 |
| JP | 2003-308752 | A | 10/2003 |
| JP | 2007-280810 | A | 10/2007 |
| JP | 2008-060058 | A | 3/2008 |
| JP | 2008-235065 | A | 10/2008 |

* cited by examiner

KEY SWITCH STRUCTURE

TECHNICAL FIELD

The present invention relates to a key switch structure of a keyboard that is used as an input device in an information processing device, a measurement device, a medical device, and the like, and particularly, to a key switch structure having an illuminating function.

BACKGROUND ART

Recently, a keyboard having an illuminating function has been disclosed in, for example, Japanese Patent Application Laid-Open (JP-A) No. 2002-260478 (refer to FIG. 7) and the like. In the key structure disclosed in this Patent Document, an elastic member and a linking mechanism are disposed below a key top, and a membrane circuit board, a light guiding plate, and a base plate are disposed therebelow. In addition to the configuration in which a light emitting diode (LED) as a light emitting element is provided on the membrane circuit board, there is also disclosed a configuration in which an LED is provided on an exclusive circuit board. When the exclusive circuit board is provided, the circuit board is disposed below the base plate.

In the key switch structure disclosed in this Patent Document, when light is emitted from the LED as the light emitting element, the light is guided by the light guiding plate, and is emitted upward from the light guiding plate at a position below the key top. Accordingly, a character, a symbol, and the like on the key top are brightly illuminated.

SUMMARY OF INVENTION

Technical Problem

However, in the key switch structure disclosed in this Patent Document, the plate and the light guiding plate are formed as separate members. Accordingly, the height of the entire key switch is high, which is an obstacle in attaining a thin key switch. Further, when the height of the key switch is high, it is difficult to mount the key switch on a personal computer (PC) or to replace a key switch without an illuminating function with a key switch with an illuminating function. Further, since many components are used, manufacturing costs become high. Furthermore, since a process of bonding the light guiding plate and the base plate to each other is required in the manufacturing process, manufacturing costs become high also due to this reason.

Therefore, the invention provides a key switch structure in which the height of the key switch is reduced and the number of components is reduced, so that the manufacturing costs are lowered.

Solution to Problem

According to an aspect of the invention, there is provided a key switch structure including: a key top; a linking mechanism adapted to support and allow elevation of the key top; a membrane sheet having a contact point portion; a back plate disposed below the membrane sheet, supporting the linking mechanism, and having a light guiding function; and a sheet member having a light emitting element disposed thereon, wherein the light emitting element is disposed to be adjacent to the back plate.

Advantageous Effects of Invention

According to the invention, since the back plate is endowed with a function to guide light, the height of the key switch may be reduced, the number of components may be reduced, and the manufacturing costs may be lowered.

DESCRIPTION OF EMBODIMENTS

Figure 1:
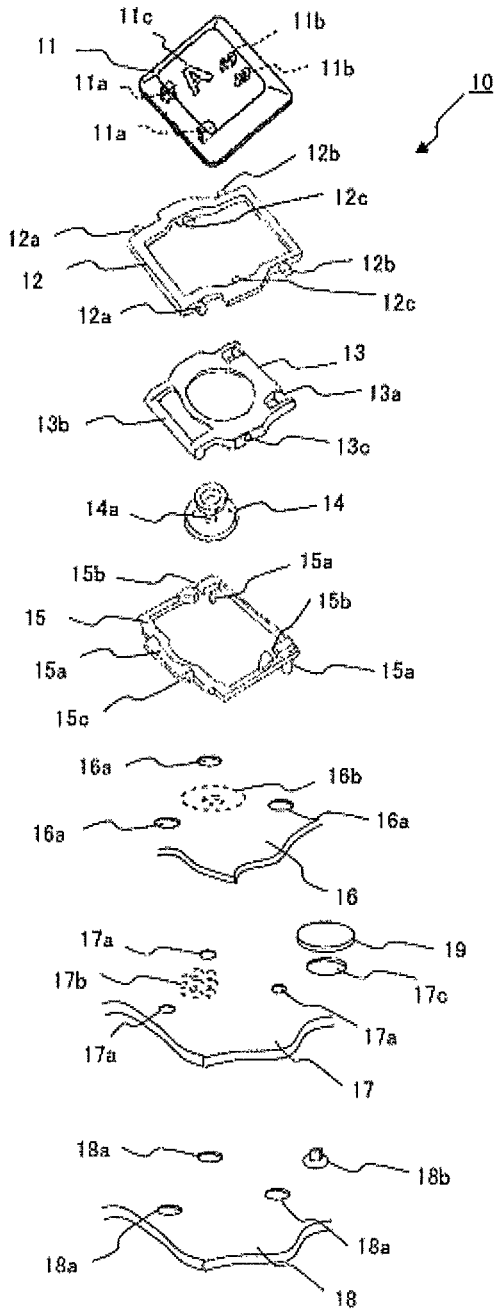
FIG. 1 is an exploded perspective view illustrating a key switch structure of a first embodiment.
Figure 2:
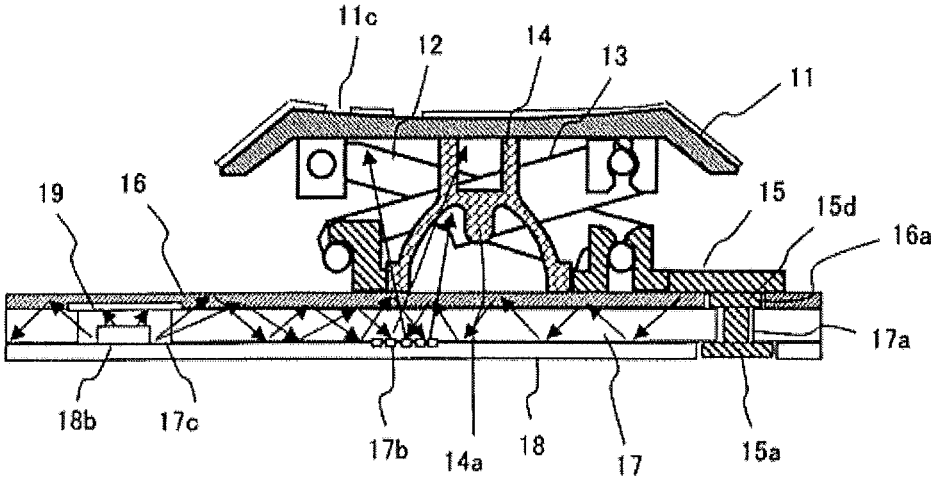
FIG. 2 is a cross-sectional view illustrating the key switch structure of the first embodiment.

Hereinafter, embodiments of the invention will be described by referring to the drawings. The same reference numerals are given to the same components in the drawings. FIG. 1 is an exploded perspective view illustrating a key switch structure of a first embodiment. FIG. 2 is a cross-sectional view illustrating the key switch structure of the first embodiment.

In FIGS. 1 and 2, a key switch 10 of a first embodiment includes a key top 11, a first linking member 12 which is adapted to be slidable with respect to the key top 11, a second linking member 13 which is adapted to be rotatable with respect to the key top 11, a rubber dome (elastic member) 14 which is bent when the key top 11 is pressed down and returns the key top 11 to the original position when the pressing force is released, a holder 15 which holds the first and second linking members 12 and 13, a membrane sheet 16 which has a contact point portion directly beneath the rubber dome 14, a back plate 17 which supports the holder 15 and has a light guiding function, and an LED sheet 18 on which a light emitting diode (LED) is disposed.

A character or symbol 11*c* is formed on the surface (front surface) of the key top 11, where the entire key top is painted, and a character portion is formed thereon by laser or the like. The rear surface of the key top 11 is provided with a sliding support portion 11*a* which slidably supports, in the horizontal direction, a sliding pin 12*a* of the first linking member 12, and a rotation support portion lib which rotatably supports a rotation pin 13*a* of the second linking member 13. The first linking member 12 is formed in a substantially frame shape, and includes a pin 12*c* which is inserted into a pivot hole 13*c* (in FIG. 1, only one of the pivot holes is shown, but the pivot holes 13*c* are formed at both sides) of the second linking member 13 and a pin 12*b* which is rotatably supported by a pivot portion 15*b* of the holder 15 in addition to the sliding pin 12*a*.

The second linking member 13 includes a pivot hole 13*c* into which the pin 12*c* of the first linking member 12 is inserted and a pin 13*b* which is slidably guided by a sliding support portion 15*c* of the holder 15 in addition to the rotation pin 13*a* that is rotatably held by the rotation support portion 11*b* of the key top 11. The rubber dome 14 is disposed below the key top 11, and is formed of a material such as rubber and in a substantially cup shape, where a contact point pressing portion 14*a* is formed protruding downward from the center of the inner surface of the rubber dome, so that a contact point portion 16*b* of the membrane sheet 16 may be pressed down by the contact point pressing portion. A linking mechanism includes the first linking member 12 and the second linking member 13.

Figure 3:
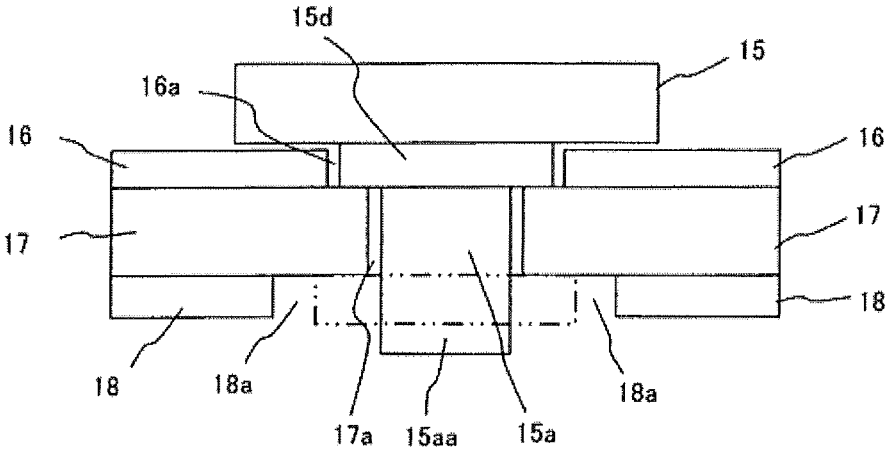
FIG. 3 is an enlarged view illustrating a welded state of a welding pin of the first embodiment.

The holder 15 is separately formed in a frame shape for each key. The holder 15 includes a pivot portion 15*b* which rotatably supports the pin 12*b* of the first linking member 12, a sliding support portion 15*c* which slidably supports the pin 13*b* of the second linking member 13, and plural welding pins 15*a* which are fitted into holes 17*a* formed in the back plate 17 having a light guiding function. A flange portion 15*d* is formed at the upper portion (base portion) of each welding pin 15*a* as shown in FIG. 2. The diameter of the flange portion 15*d* is set to be slightly smaller than the diameter of the hole 16*a* of the membrane sheet 16. Further, the thickness of the flange portion 15*d* is set to be slightly thicker than the thickness of the membrane sheet 16. When the key switch is assembled, the welding pin 15*a* is fitted into the hole 17*a* of the back plate 17, and the tip portion of the welding pin 15*a* is welded as shown in FIG. 3 to be deformed in a plane shape, so that the pin is fixed to the periphery of the lower portion of the hole 17*a*. Accordingly, the holder 15 is strongly fixed to the back plate 17 while the welding pin 15*a* does not protrude downward. Further, FIG. 3 is an enlarged view illustrating a welded state of the welding pin of the first embodiment.

The first linking member 12, the second linking member 13, and the holder 15 are formed of a transparent or translucent material. The membrane sheet 16 includes the contact point portion 16*b* which is pressed down by the contact point pressing portion 14*a* of the rubber dome 14 and a hole 16*a* into which the flange portion 15*d* of the holder 15 is inserted. While not shown in the drawings, the membrane sheet 16 includes upper and lower flexible sheets and a spacer sheet interposed therebetween and the spacer sheet is provided with plural through-holes corresponding to the plural keys. The through-hole forms a space between the upper and lower sheets, a fixed contact point is provided at the lower sheet on the side of the back plate 17, a movable contact point is provided at the upper sheet on the side of the rubber dome 14, so that these contact points face one another inside the space. The fixed contact point and the movable contact point constitute the contact point portion 16*b*.

The back plate 17 having a light guiding function is formed of a resin having transparency or high transmissivity, and light is transmitted through the back plate while being refracted therein. In the back plate 17, the hole 17*a* is perforated at plural positions corresponding to the holes 16*a* of the membrane sheet 16 so that the welding pin 15*a* of the holder 15 is fitted thereinto. Further, a through-hole 17*c* is provided at a position corresponding to the position where an LED 18*b* is disposed. The hole 17*a* is formed to have a diameter smaller than the diameter of the hole 16*a* of the membrane sheet 16. A shielding (reflecting) seal 19 is attached to the upper portion of the through-hole 17*c* so that the light emitted from the LED 18*b* does not leak.

The shielding seal 19 has luminance higher than that of the LED 18*b*, and is disposed at a position where the light of the LED 18*b* is transmitted from the back plate 17 to the membrane sheet 16. The back plate 17 is provided with a reflecting portion 17*b*. The reflecting portion 17*b* is provided at a position corresponding to the character or symbol 11*c* of the key top 11. Accordingly, plural reflecting portions 17*b* may be provided for each key switch. The reflecting portion 17*b* may be printed in shapes of dots or shaped by forming convex or concave shapes.

In the LED sheet 18, a welding hole 18*a* is provided at a position corresponding to the welding pin 15*a* of the holder 15, and the LED 18*b* is disposed at a position corresponding to the through-hole 17*c* of the back plate 17. The welding hole 18*a* is formed to be sufficiently larger than the hole 17*a* of the back plate 17. The LED 18*b* may be disposed at an arbitrary position on the LED sheet 18. The front surface of the LED sheet 18 and the rear surface of the back plate 17 are adhered to each other by adhesive or the like.

Figure 4:
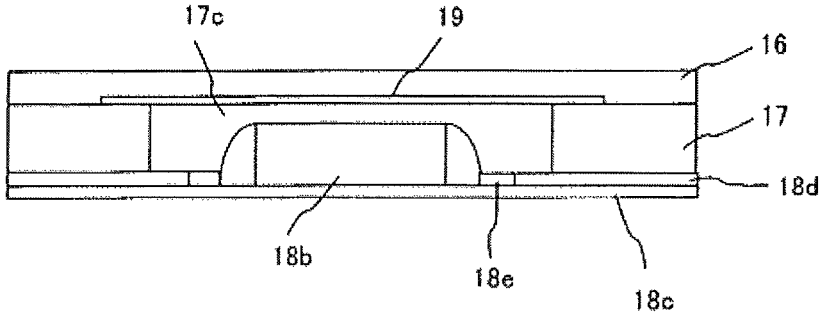
FIG. 4 is an enlarged view specifically illustrating an LED housing of the first embodiment.

FIG. 4 is an enlarged view specifically illustrating an LED housing of the first embodiment, where the membrane sheet 16, the back plate 17, the LED sheet 18, and the LED 18*b* are shown. In FIG. 4, the LED sheet 18 includes a lower LED sheet portion 18*c* and an upper reflecting sheet portion 18*d*. The front surface of the lower LED sheet portion 18*c* and the rear surface of the upper reflecting sheet portion 18*d* are adhered to each other. The upper reflecting sheet portion 18*d* is provided with a hole 18*e* corresponding to the LED 18*b*. The LED 18*b* is disposed on the lower LED sheet portion 18*c*, and a pattern is printed on the sheet. The LED 18*b* is bonded. The lower LED sheet portion 18*c* and the upper reflecting sheet portion 18*d* are adhered to each other with water-resistant starch or the like so as to have a water-resistant function. Further, the upper reflecting sheet portion 18*d* may have a reflecting function by printing a reflective material on the front surface or the rear surface of the transparent PET (polyethylene terephthalate) sheet. The LED 18*b* may be mounted without forming a hole.

Next, the welding operation of the welding pin will be described by referring to FIG. 3. FIG. 3 illustrates a state where the LED sheet 18, the back plate 17, and the membrane sheet 16 are laminated, and the holder 15 is disposed on the laminated structure. At this time, as depicted by the solid line, the welding pin 15*a* of the holder 15 protrudes downward through the hole 17*a* of the back plate 17 and the welding hole 18*a* of the LED sheet 18. Further, since the diameter of the flange portion 15*d* is larger than that of the hole 17*a* of the back plate 17, the flange portion is disposed on the front surface of the back plate 17. Since the diameter of the flange portion 15*d* is smaller than that of the hole 16*a* of the membrane sheet 16, a minute gap is formed between the flange portion 15*d* and the membrane sheet 16. The membrane sheet 16 may be thermally expanded depending on a temperature, and the thermal expansion may be handled by using the gap.

Here, a tip portion 15*aa* of the welding pin 15*a* is heated, the tip portion 15*aa* is deformed in a plane shape as depicted by the two-dotted chain line, and is fixed to the lower outer peripheral portion of the hole 17*a* of the back plate 17. Accordingly, the holder 15 is fixed to the back plate 17. The welded tip portion 15*aa* of the welding pin 15*a* does not protrude downward beyond the LED sheet 18.

Next, the switch operation will be described. In FIG. 2, when the key top 11 is pressed down by an arbitrary load from the upside, the key top 11 moves downward, so that the rubber dome 14 is bent. Then, the contact point pressing portion 14*a* of the rubber dome 14 presses down a contact point portion (not shown) of the membrane sheet 16. Accordingly, the switch is closed. Further, due to the action of the first linking member 12 and the second linking member 13, the key top 11 moves downward in a horizontal posture so that the switch is closed even when any part on the upper portion of the key top 11 is pressed down.

Next, the illuminating operation will be described. In FIG. 2, when the LED 18*b* is turned on by a power supply (not shown), the light emitted from the LED 18*b* passes through the inside of the back plate 17 having a light guiding function. The upper portion of the LED 18*b* is provided with the shielding seal 19. For this reason, the light emitted from the LED 18*b* is reflected by the shielding seal 19 without leaking upward, and passes through the inside of the back plate 17 as depicted by the arrow. The light is reflected by the reflecting portion 17*b* provided at a position corresponding to the character or symbol 11*c* of the key top 11, and the reflected light is emitted toward the key top 11 through the membrane sheet 16.

The membrane sheet 16 is formed of an optically-transparent material. The light is transmitted through the membrane sheet 16, and is transmitted through the holder 15 and the rubber dome 14 so that it arrives at the rear surface of the key top 11. The character or symbol 11*c* of the key top 11 is illuminated from its rear surface, so that its front surface is visibly lit.

As described above, in the first embodiment, one sheet, that is, the back plate 17 having a light guiding function is provided. Therefore, compared to the related art in which two sheets, that is, the light guiding plate and the back plate are provided, the height of the entire key switch is reduced. Further, since the base portion (which includes the membrane sheet 16, the back plate 17, and the LED sheet 18) is thinned, it is easy to mount the key switch on the PC or replace the key switch without an illuminating function with the key switch with an illuminating function.

Further, since the number of components is reduced, manufacturing costs may be reduced. Further, since the light guide function and the function of the back plate are realized by a single member, the keyboard may be manufactured by the same process as that of the keyboard without an illuminating function of the related art. Furthermore, since the LED sheet 18 is provided, the height of the entire key switch may be further reduced. Further, since the LED sheet 18 is provided, a water-resistant function may be obtained.

Figure 5:
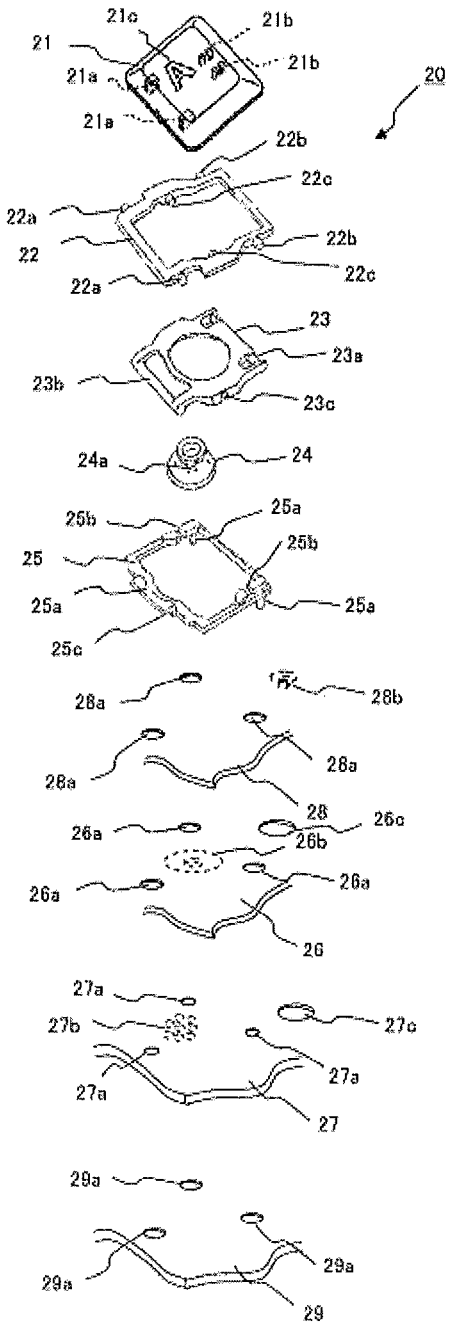
FIG. 5 is an exploded perspective view illustrating a key switch structure of a second embodiment.
Figure 6:
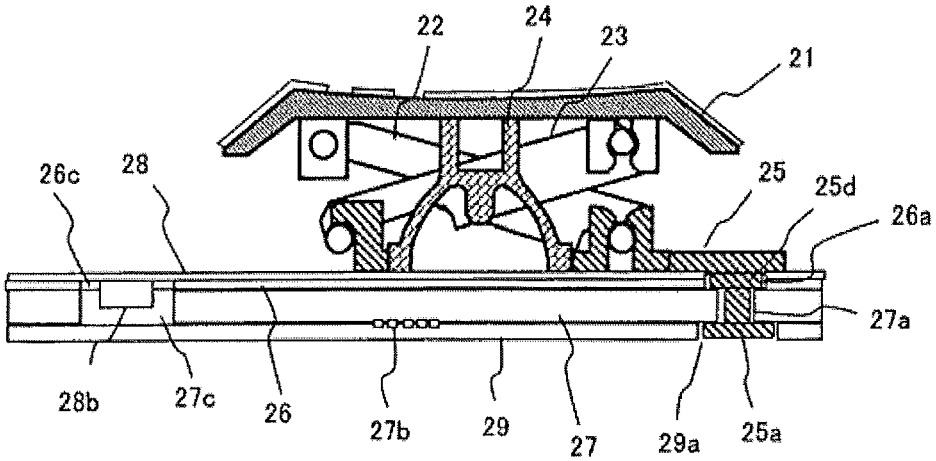
FIG. 6 is a cross-sectional view illustrating the key switch structure of the second embodiment.

Next, a second embodiment of the invention will be described. FIG. 5 is an exploded perspective view illustrating a key switch structure of a second embodiment. FIG. 6 is a cross-sectional view illustrating the key switch structure of the second embodiment. In FIGS. 5 and 6, a key switch 20 of the second embodiment includes a key top 21, a first linking member 22 which is adapted to be slidable with respect to the key top 21, a second linking member 23 which is adapted to be rotatable with respect to the key top 21, a rubber dome 24 which is bent when the key top 21 is pressed down and returns the key top 21 to the original position when the pressing force is released, a holder 25 which holds the first and second linking members 22 and 23, an LED sheet 28 on which an LED is disposed, a membrane sheet 26 which has a contact point portion directly beneath the rubber dome 24, a back plate 27, and a reflecting sheet 29.

Among the constituents, the key top 21, the first linking member 22, the second linking member 23, the rubber dome 24, the holder 25, and the membrane sheet 26 have the same configurations as those of the first embodiment. Accordingly, the detailed description thereof will be omitted.

In the LED sheet 28, a hole 28*a* is provided at a position corresponding to a welding pin 25*a* of the holder 25. The diameter of the hole 28*a* is set to be larger than that of a flange portion 25*d* of the welding pin 25*a*. Further, an LED 28*b* is disposed at a position corresponding to the through-hole 27*c* of the back plate 27. The LED 28*b* may be disposed at an arbitrary position on the LED sheet 28.

Figure 7:
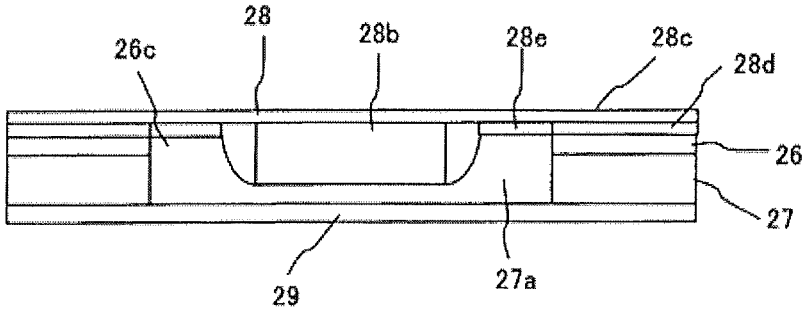
FIG. 7 is an enlarged view specifically illustrating an LED housing of the second embodiment.
Figure 8:
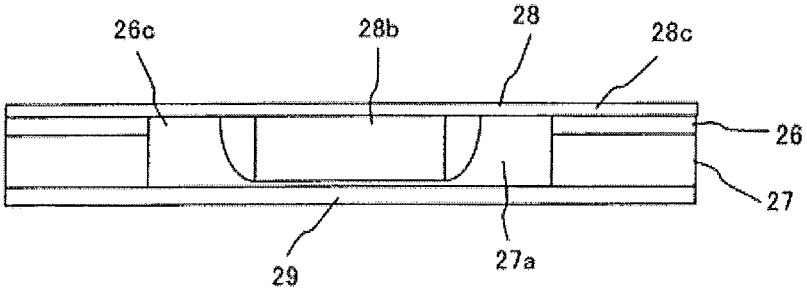
FIG. 8 is an enlarged view specifically illustrating the LED housing of the second embodiment.

FIGS. 7 and 8 are enlarged views specifically illustrating the LED housing of the second embodiment. In FIG. 7, the LED sheet 28 includes an upper LED sheet portion 28*c* and a lower reflecting sheet portion 28*d*. The rear side of the upper LED sheet portion 28*c* and the front side of the lower reflecting sheet portion 28*d* are adhered to each other. In the lower reflecting sheet portion 28*d*, a hole 28*e* is provided at a position corresponding to the LED 28*b*. The LED 28*b* is disposed downward in the upper LED sheet portion 28*c*, and a pattern is printed on the sheet. The LED 28*b* is bonded. The upper LED sheet portion 28*c* and the lower reflecting sheet portion 28*d* are adhered to each other with water-resistant starch or the like so as to have a water-resistant function. Further, the upper reflecting sheet portion 28*d* may have a reflecting function by printing a reflective material on the front surface or the rear surface of the transparent PET (polyethylene terephthalate) sheet.

However, the lower reflecting sheet portion 28*d* may not necessarily have the reflecting function. In this case, the membrane sheet 26 is allowed to have the reflecting function. Then, when the LED sheet 28 is not formed to have the reflecting function, the LED sheet 28 includes only the upper LED sheet portion 28*c* as shown in FIG. 8. That is, the upper LED sheet portion 28*c* is the LED sheet 28. The LED sheet 28 is disposed above the membrane sheet 26. When both of the upper LED sheet portion 28*c* and the lower reflecting sheet portion 28*d* are disposed, the upper LED sheet portion 28*c* and the lower reflecting sheet portion 28*d* are adhered to each other by water-resistant starch or the like so as to have a water-resistant function. When the water-resistant function is not required, only the upper LED sheet portion 28*c* is provided.

The membrane sheet 26 includes a contact point portion 26*b* which is pressed down by a contact point pressing portion 24*a* of the rubber dome 24. Further, the membrane sheet 26 is provided with a hole 26*a* into which the flange portion 25*d* (shown in FIG. 6) of the holder 25 is inserted and a hole 26*c* into which the LED 28*b* is inserted. The back plate 27 having a light guiding function like the first embodiment is formed of a resin having transparency or high transmissivity, and light is transmitted through the back plate while being refracted therein. In the back plate 27, the hole 27*a* is perforated at plural positions corresponding to the holes 26*a* of the membrane sheet 26 so that the welding pin 25*a* of the holder 25 is fitted thereinto. Further, a through-hole 27*c* is provided at a position corresponding to the position where an LED 28*b* is disposed. The hole 27*a* is formed to have a diameter smaller than the diameter of the hole 26*a* of the membrane sheet 26. Further, a shielding seal used for blocking the through-hole 27*c* is not provided below the through-hole 27*c*. The back plate 27 is provided with a reflecting portion 27*b*.

In the reflecting sheet 29, a hole 29*a* is provided at a position corresponding to the welding pin 25*a* of the holder 25. The reflecting sheet 29 is adhered to the rear side of the back plate 27 by adhesive or the like. A hole is not provided at a position corresponding to the through-hole 27*c* in the reflecting sheet 29. Through the reflecting sheet 29, the light emitted from the LED 28*b* is reflected toward the back plate 27.

Next, the welding operation of the welding pin will be described. In FIG. 6, the reflecting sheet 29, the back plate 27, the membrane sheet 26, and the LED sheet 28 are laminated, and the holder 25 is disposed on the laminated structure. The welding pin 25*a* of the holder 25 protrudes downward through the hole 27*a* of the back plate 27 and hole 29*a* of the reflecting sheet 29. Further, the flange portion 25*d* is disposed on the front surface of the back plate 27. The diameter of the flange portion 25*d* is smaller than the diameter of the hole 26*a* of the membrane sheet 26 and the diameter of the hole 28*a* of the LED sheet 28. Accordingly, a minute gap is formed between the flange portion 25*d* and the pair of the membrane sheet 26 and the LED sheet 28.

Here, when the tip portion of the welding pin 25*a* is heated, the tip portion is deformed, and is fixed to the lower outer peripheral portion of the hole 27*a* of the back plate 27. Accordingly, the holder 25 is fixed to the back plate 27. The welded tip end portion of the welding pin 25*a* does not protrude downward beyond the reflecting sheet 29.

Next, the illuminating operation will be described. In FIG. 6, when the LED 28*b* is turned on by a power supply (not shown), the light emitted from the LED 28*b* passes through the inside of the back plate 27 having a light guiding function. The reflecting sheet 29 is provided below the LED 28*b*. Accordingly, the light emitted from the LED 28*b* is reflected by the reflecting sheet 29 without leaking downward, and transmitted inside the back plate 27. Further, the membrane sheet 26 or the LED sheet 28 above the back plate 27 is allowed to have a reflecting function. Accordingly, the light emitted from the LED 28*b* transmitted inside the back plate 27 without leaking upward. The light is reflected by the reflecting portion 27*b* provided at a position corresponding to the character or symbol of the key top 21. The reflected light is emitted toward the key top 21 through the membrane sheet 26.

Hereinafter, as in the first embodiment, the light is transmitted through the membrane sheet 26, and is transmitted through the holder 25 and the rubber dome 24, so that the light arrives at the rear surface of the key top 21. The character or symbol of the key top 21 is illuminated from its rear surface, so that its front surface is visibly lit.

As described above, in the second embodiment, one sheet, that is, the back plate 17 having a light guiding function is provided as in the first embodiment. Therefore, compared to the related art in which two sheets, that is, the light guiding plate and the back plate are provided, the height of the entire key switch is reduced, and the base portion is thinned. Accordingly, it is easy to mount the key switch on the PC or replace the key switch without an illuminating function with the key switch with an illuminating function.

Further, since the number of components is reduced, manufacturing costs may be reduced. Further, since the light guide function and the function of the back plate are realized by one member, the keyboard may be manufactured by the same process as that of the keyboard without an illuminating function of the related art. Further, in the second embodiment, since the LED 28*b* is formed to protrude downward, the front surface of the keyboard may be less influenced by the brightness of the LED 28*b*. Furthermore, it is not necessary to attach the shielding seal used for blocking the through-hole 27*c* of the back plate 27 on which the LED 28*b* is disposed.

Figure 9:
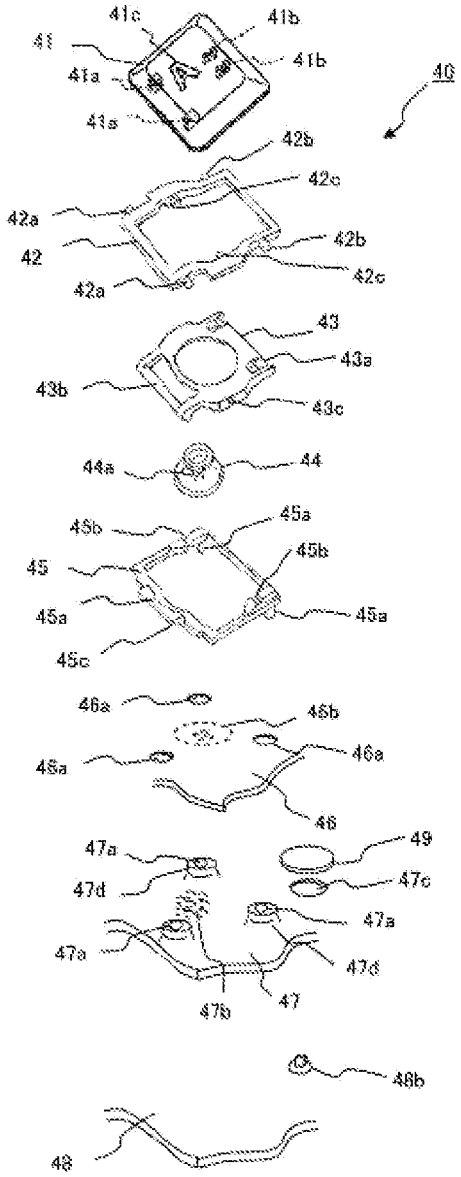
FIG. 9 is an exploded perspective view illustrating a key switch structure of a third embodiment.
Figure 10:
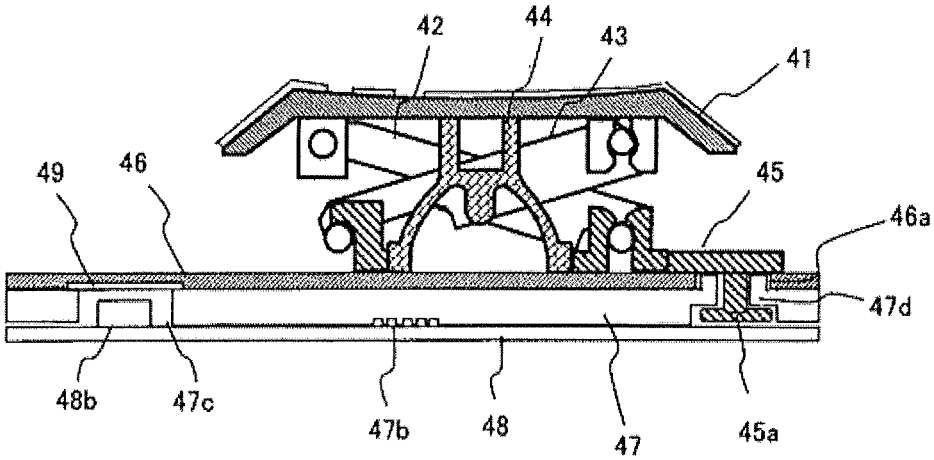
FIG. 10 is a cross-sectional view illustrating the key switch structure of the third embodiment.

Next, a third embodiment of the invention will be described. FIG. 9 is an exploded perspective view illustrating a key switch structure of the third embodiment. FIG. 10 is a cross-sectional view illustrating the key switch structure of the third embodiment. In FIGS. 9 and 10, a key switch 40 of the third embodiment includes a key top 41, a first linking member 42 which is adapted to be slidable with respect to the key top 41, a second linking member 43 which is adapted to be rotatable with respect to the key top 41, a rubber dome 44 which is bent when the key top 41 is pressed down and returns the key top 41 to the original position when the pressing force is released, a holder 45 which holds the first and second linking members 42 and 43, a membrane sheet 46 which has a contact point portion directly beneath the rubber dome 44, a back plate 47, and an LED sheet 48.

Among the constituents, the key top 41, the first linking member 42, the second linking member 43, the rubber dome 44, the holder 45, and the membrane sheet 46 have the same configurations as those of the first embodiment. Accordingly, the detailed description thereof will be omitted. Further, a flange portion is not formed at a welding pin 45*a* of the holder 45.

In the back plate 47 having a light guiding function, a hole 47*a* is perforated in plural positions corresponding to holes 46*a* of the membrane sheet 46 so that the welding pin 45*a* of the holder 45 is fitted thereinto, and a through-hole 47*c* is provided at a position corresponding to the disposition position of the LED 48*b*. Further, the back plate 47 is provided with a striking-out portion 47*d*. The hole 47*a* is formed at the striking-out portion 47*d*. The diameter of the hole 47*a* is smaller than that of the hole 46*a* of the membrane sheet 46. A shielding (reflecting) seal 49 is attached to the upper portion of the through-hole 47*c* so that the light emitted from the LED 48*b* does not leak therefrom.

The shielding seal 49 has brightness stronger than that of the LED 48*b*, and is disposed at a position where the light of the LED 48*b* is transmitted from the back plate 47 to the membrane sheet 46. The back plate 47 is provided with a reflecting portion 47*b*. The reflecting portion 47*b* is provided at a position corresponding to the character or symbol of the key top 41. The reflecting portion 47*b* may be printed as a dot shape.

The height of the striking-out portion 47*d* of the back plate 47 is slightly higher than the thickness of the membrane sheet 46. A space is formed below the striking-out portion 47*d*, and the tip portion of the welding pin 45*a* of the holder 45 is welded in the space. Accordingly, even after the welding operation is performed, as shown in FIG. 10, the bottom surface is horizontally maintained without forming a hole in the LED sheet 48. For this reason, a hole is not formed in the LED sheet 48 like the first embodiment.

The assembling operation and the illuminating operation of the third embodiment are the same as those of the first embodiment. According to the third embodiment, the striking-out portion 47*d* is provided in the back plate 47 having a light guiding function in addition to the first embodiment. Accordingly, since the welded tip portion of the welding pin 45*a* is inserted into the striking-out portion 47*d*, the welded portion does not protrude downward beyond the back plate 47. Since it is not necessary to provide the hole in the LED sheet 48, the water-resistant property may be also ensured.

Figure 11:
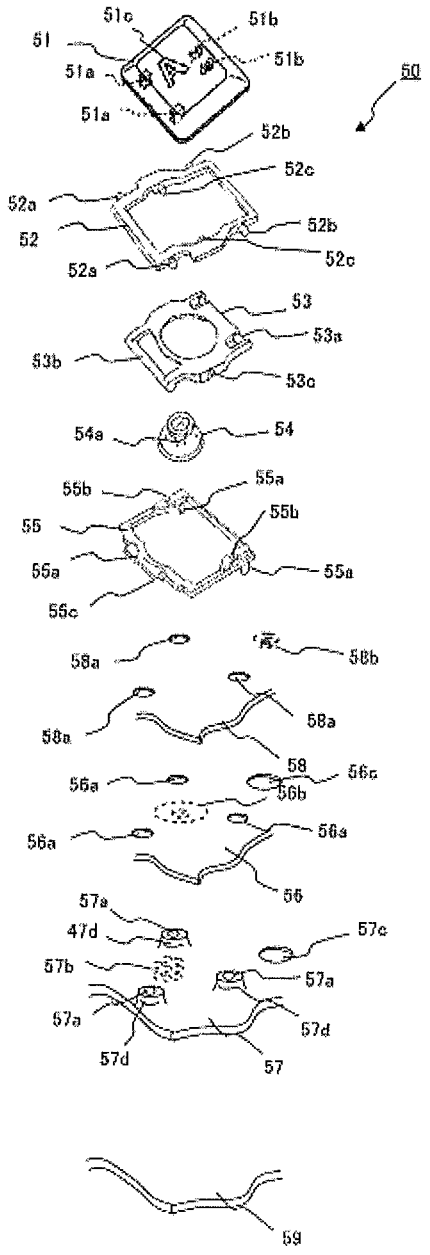
FIG. 11 is en exploded perspective view illustrating a key switch structure of a fourth embodiment.
Figure 12:
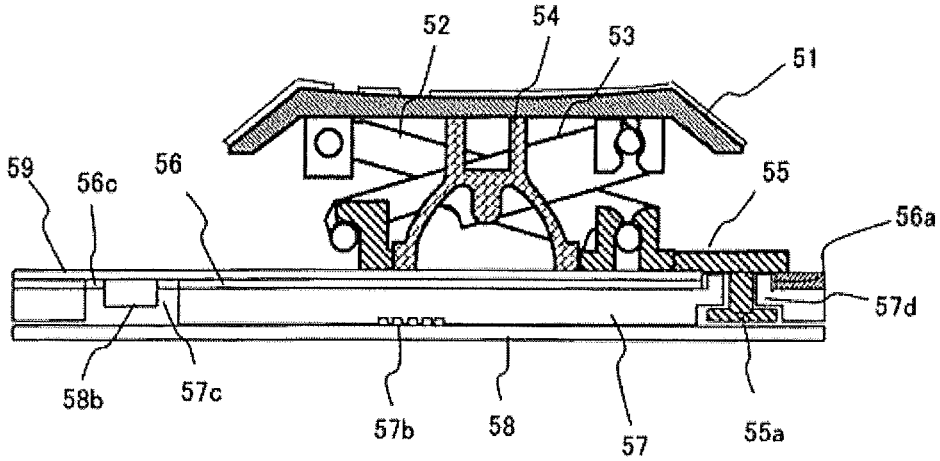
FIG. 12 is a cross-sectional view illustrating the key switch structure of the fourth embodiment.

Next, a fourth embodiment of the invention will be described. FIG. 11 is an exploded perspective view illustrating a key switch structure of the fourth embodiment. FIG. 12 is a cross-sectional view illustrating the key switch structure of the fourth embodiment. In FIGS. 11 and 12, a key switch 50 of the fourth embodiment includes a key top 51, a first linking member 52 which is adapted to be slidable with respect to the key top 51, a second linking member 53 which is adapted to be rotatable with respect to the key top 51, a rubber dome 54 which is bent when the key top 51 is pressed down and returns the key top 51 to the original position when the pressing force is released, a holder 55 which holds the first and second linking members 52 and 53, an LED sheet 58, a membrane sheet 56 which has a contact point portion directly beneath the rubber dome 54, a back plate 57, and a reflecting sheet 59.

Among the constituents, the key top 51, the first linking member 52, the second linking member 53, the rubber dome

54, the holder 55, the LED sheet 58, and the membrane sheet 56 have the same configurations as those of the second embodiment. Accordingly, the detailed description thereof will be omitted. Further, a flange portion is not formed at a welding pin 55*a* of the holder 55.

In the back plate 57 having a light guiding function, a hole 57*a* is perforated in plural positions corresponding to holes 56*a* of the membrane sheet 56 so that the welding pin 55*a* of the holder 55 is fitted thereinto, and a through-hole 57*c* is provided at a position corresponding to the position at which the LED 58*b* is disposed. Further, the back plate 57 is provided with a striking-out portion 57*d*. The hole 57*a* is formed at the striking-out portion 57*d*. The diameter of the hole 57*a* is smaller than that of the hole 56*a* of the membrane sheet 56. A shielding seal is not attached to the lower portion of the through-hole 57*c*. Further, the back plate 57 is provided with a reflecting portion 57*b* printed in a dot shape. The reflecting sheet 59 provided below the back plate 57 is not provided with a hole like the second embodiment.

As in the third embodiment, the height of the striking-out portion 57*d* of the back plate 57 is slightly higher than the thickness of the membrane sheet 56. A space is formed below the striking-out portion 57*d*, and the tip portion of the welding pin 55*a* of the holder 55 is welded in the space. Accordingly, even after the welding operation is performed, as shown in FIG. 12, the bottom surface is horizontally maintained without forming a hole in the LED sheet 58. For this reason, a hole is not formed in the LED sheet 58 like the second embodiment.

The assembling operation and the illuminating operation of the fourth embodiment are the same as those of the second embodiment. According to the fourth embodiment, a striking-out portion 57*d* is provided in the back plate 57 in addition to the second embodiment. Accordingly, since the welded tip portion of the welding pin 55*a* is disposed inside the striking-out portion 57*d*, the welded portion does not protrude downward beyond the back plate 57. Since it is not necessary to provide the hole in the reflecting sheet 59, the water-resistant property may be also ensured.

What is claimed is:

1. A key switch structure comprising:

a key top;

a linking mechanism adapted to support and allow elevation of the key top;

a membrane sheet having a contact point portion;

a back plate disposed below the membrane sheet and supporting the linking mechanism, the back plate including a through-hole;

a light emitting element disposed adjacent to the back plate and outside of a region of the back plate that the key to covers;

a sheet member having the light emitting element disposed thereon; and a holder member disposed on the membrane sheet and supporting the linking mechanism, the holder member including a protrusion portion that protrudes from a part of the holder member toward the back plate, the protrusion portion being both fitted and inserted into the through-hole, and a tip portion of the protrusion portion is fixed to the back plate, wherein the back plate has a light guiding function that guides light emitted by the light emitting element, that is disposed outside of the region of the back plate that the key top covers, to the region of the back plate that the key top covers, wherein a base portion of the protrusion portion is provide with a flange portion having a diameter larger than that of the through-hole, and wherein a thickness of the flange portion is thicker that that of the membrane sheet, wherein the membrane sheet includes a hole into which the flange portion is fitted, the diameter of the flange portion is smaller than that of the hole of the membrane sheet.

2. The key switch structure according to claim 1, wherein the sheet member is disposed below the back plate.

3. The key switch structure according to claim 1, wherein the sheet member is disposed above the back plate.

4. The key switch structure according to claim 1, wherein the back plate includes a striking-out portion protruding toward the membrane sheet from a part of the back plate, and the through-hole is provided in the striking-out portion.

5. The key switch structure according to claim 1, wherein the entire light emitting element is disposed at a position that is completely outside of an entire region that the entire key top covers in a cross-sectional view of the key switch structure.

6. The key switch structure according to claim 1, wherein the tip portion of the protrusion portion is in direct contact with the back plate.

7. The key switch structure according to claim 1, wherein the tip portion of the protrusion portion is welded to the back plate.

* * * * *